US009103530B2

(12) United States Patent
Gassner et al.

(10) Patent No.: US 9,103,530 B2
(45) Date of Patent: Aug. 11, 2015

(54) ARRANGEMENT FOR DIRECTED LIGHT EMISSION

(75) Inventors: Patrick Gassner, St. Gerold (AT); Michael Spiegel, Dornbirn (AT)

(73) Assignee: Zumtobel Lighting GmbH, Dornbirn (AT)

( * ) Notice: Subject to any disclaimer, the term of this patent is extended or adjusted under 35 U.S.C. 154(b) by 132 days.

(21) Appl. No.: 13/825,270

(22) PCT Filed: Sep. 26, 2011

(86) PCT No.: PCT/EP2011/066641

§ 371 (c)(1),
(2), (4) Date: Apr. 19, 2013

(87) PCT Pub. No.: WO2012/049006

PCT Pub. Date: Apr. 19, 2012

(65) Prior Publication Data

US 2013/0223057 A1 Aug. 29, 2013

(30) Foreign Application Priority Data

Sep. 27, 2010 (DE) ..... 10 2010 041 478

(51) Int. Cl.

| | |
|---|---|
| ***F21V 17/00*** | (2006.01) |
| ***F21S 8/04*** | (2006.01) |
| ***F21V 3/02*** | (2006.01) |
| ***F21V 3/04*** | (2006.01) |
| ***F21V 5/02*** | (2006.01) |
| *F21Y 101/02* | (2006.01) |

(Continued)

(52) U.S. Cl.

CPC ..... *F21V 17/002* (2013.01); *F21S 8/04* (2013.01); *F21V 3/02* (2013.01); *F21V 3/04* (2013.01); *F21V 5/02* (2013.01); *F21V 7/22* (2013.01); *F21V 13/02* (2013.01); *F21V 13/12* (2013.01); *F21V 17/164* (2013.01); *F21Y 2101/02* (2013.01); *F21Y 2103/003* (2013.01)

(58) Field of Classification Search

CPC ..... F21V 17/002; F21V 5/02; F21V 3/04; F21V 3/02; F21V 7/22; F21V 13/12; F21V 17/164; F21V 13/02; F21S 8/04; F21Y 2103/003; F21Y 2101/02

USPC ..... 362/223

See application file for complete search history.

(56) References Cited

U.S. PATENT DOCUMENTS

| | | | | |
|---|---|---|---|---|
| 7,618,157 | B1 | 11/2009 | Galvez et al. | |
| 2008/0086922 | A1 | 4/2008 | Chen et al. | |
| 2011/0069496 | A1 * | 3/2011 | Ing et al. | 362/311.02 |

FOREIGN PATENT DOCUMENTS

DE 103 53 644 A1 2/2005

OTHER PUBLICATIONS

International Search Report issued in connection with the corresponding International Application No. PCT/EP2011/066641 on Apr. 5, 2012.

*Primary Examiner* — Anne Hines

(74) *Attorney, Agent, or Firm* — The H.T. Than Law Group

(57) ABSTRACT

The invention relates to an arrangement for light emission, comprising at least one LED illuminant in a long arrangement, a carrier element carrying the LED illuminant, and a light emitting element that can be connected to the carrier element. The light emitting element comprises a first region (41) wherein traversing light is extensively scattered. It also comprises a second region (40) wherein traversing light is scattered significantly less than in the first region.

16 Claims, 3 Drawing Sheets

(51) Int. Cl.

| | | | |
|---|---|---|---|
| *F21Y 103/00* | (2006.01) | *F21V 13/02* | (2006.01) |
| *F21V 7/22* | (2006.01) | *F21V 13/12* | (2006.01) |
| | | *F21V 17/16* | (2006.01) |

ARRANGEMENT FOR DIRECTED LIGHT EMISSION

The subject matter of the application is an arrangement for light-emission having LED illuminants in an elongate arrangement, a carrier element which carries the LED illuminants, and a light-radiating element which can be connected to the carrier element. Further subject matter of the application is a luminaire.

BACKGROUND OF THE INVENTION

The optical capacity of LED light sources has undergone a development, making their use appear of interest for general lighting purposes. LED light sources are distinguished by their efficiency and, whilst provided the operating conditions are observed, by particular reliability. Their light-radiation characteristic as well as the operating conditions to be observed do, however, basically differ from conventional illuminants, such as, for example, incandescent bulbs, fluorescent tubes or gas-discharge lamps, so that it appears that existing luminaire constructions can only be retrofitted at considerable expense. LED light sources in this connection radiate very directed, punctiform light. This opens up additional areas of application when compared with conventional illuminants.

SUMMARY OF THE INVENTION

An object of the present invention is to provide an arrangement for light-emission which optimizes the outlay on retrofitting existing luminaire constructions and at the same time renders possible great flexibility of illumination.

This object is achieved with the features of claim 1. Further developments of the invention constitute subject matter of the dependent claims.

Basing considerations on the thought that the light-radiation characteristic and the position of installation of LEDs and conventional light sources differ for reasons of observance of the operating conditions for the respective illuminants, an arrangement is proposed for light-emission that has LED illuminants in an elongate arrangement, a carrier element which carries the LED illuminants, and a light-radiating element which can be connected to the carrier element. The light-radiating element has a first region in which traversing light is scattered to a large extent. Furthermore, it has a second region in which traversing light is scattered to a significantly smaller extent than in the first region. Usability of the light of the LED illuminant that was not originally scattered and light that is scattered is thus rendered possible in lamp constructions that are largely conventional.

The differing extent of scattering in the two regions is preferably achieved by means of differing materials of differing optical properties. Alternatively, use of a single material of differing thickness in the two regions is also possible.

In addition, the use of a common material with a differingly high quantity of scattering particles incorporated therein is also possible as an option.

For further improvement of the flexibility of the illumination, in addition prism-shaped elevations and/or depressions can be applied to the outside of the light-radiating element in order to guide the light that is not scattered.

BRIEF DESCRIPTION OF THE DRAWINGS

The invention is described by way of example in the following with reference to the drawings in which an advantageous exemplary embodiment of the invention is presented and in which.

DETAILED DESCRIPTION OF THE INVENTION

In the first instance, the general structure of the luminaire in accordance with the invention is explained with reference to FIG. 1. Subsequently, the precise technical structure and the mode of functioning of the arrangement in accordance with the invention, in particular of the light-radiating element contained therein, are pointed out with reference to FIG. 2-FIG. 5. Identical elements have in part not been repeatedly presented and described in figures that are similar.

Figure 1:
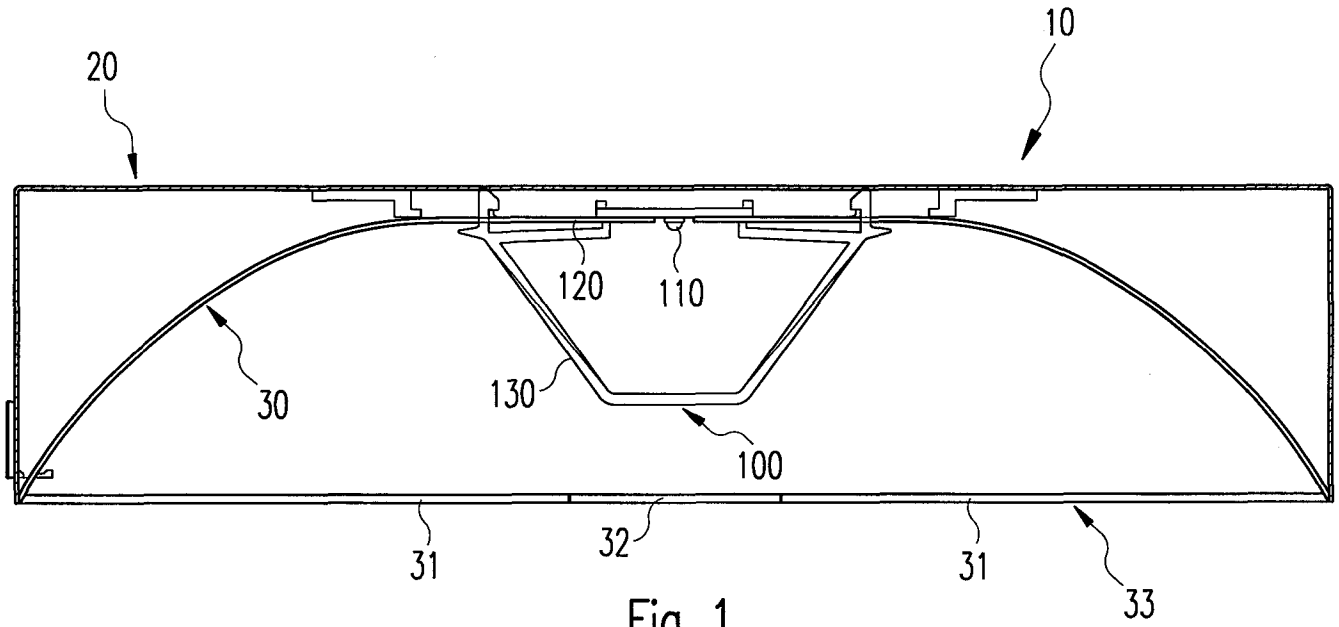
FIG. 1 shows an exemplary embodiment of the luminaire in accordance with the invention.

FIG. 1 shows an exemplary embodiment of a luminaire 10 in accordance with the invention in a sectional representation. The luminaire 10 in accordance with the invention in this case contains a housing 20, a reflector 30, an arrangement for light-emission 100 and a cover 33. With its closed side, the upper side in the drawing, the housing 20 can in this case be secured to a surface, for example a ceiling. The light-emission is effected through the arrangement for light-emission 100 in the opposite direction through the cover 33. The reflector 30 then reflects a portion of the luminous power emitted by the arrangement for light-emission 100.

The reflector 30 is in this case set up with a curved form, in particular a parabolic form. Uniform illumination of a region that is controllable in a targeted manner is thus achieved. The reflector 30 in this case ends so as to be flush with the housing 20 of the luminaire 10. The reflector 30 is provided with a focal point in the sectional representation. In three-dimensional reality, this is not a focal point, but a focal line. The focal point largely corresponds, at least in sections, with the outer surface of the light-radiating element 130. Optimum distribution of the light that is radiated by the light-radiating element 130 through the reflector 30 is thus achieved.

The arrangement for light-emission 100 contains a carrier element 120, an LED illuminant 110 and a light-radiating element 130. The carrier element 120 is in this case connected to the housing 20 of the luminaire 10. The carrier element 120 carries, furthermore, the LED illuminant 110. Alternatively, a plurality of LED illuminants 110 can also be secured to the carrier element 120. The LED illuminant 110 is preferably reversibly connected to the carrier element 120 and can be connected or separated without the use of a tool. The LED illuminant 110 is arranged in such a way that the light-radiation is effected in the direction of the open side of the housing 20 that is provided with the cover 33. Arranged between the LED illuminant 110 and the cover 33 there is, furthermore, the light-radiating element 130. In this case, it is connected to the carrier element 120 and held by it. Advantageously, this connection is reversible and can be effected and released without the use of a tool. Instead of being connected merely to the housing 20, the carrier element 120 can complete the surface of the housing 20 that is interrupted by an opening. It is thus possible to make savings in terms of material for the housing.

The light-radiating element 130 in this connection is a profiled body with a substantially trapezoidal or substantially rounded cross section. It is aligned in this case along the elongate LED illuminant 110. The light-radiating element 130 then extends over the whole length of the LED illuminant 110.

The aim of the present invention is the targeted control of the light-radiation characteristic of the LED illuminant 110. For this, the light-radiating element 130 is provided with various regions of differing light-radiation characteristics. Thus, for example, a very diffuse light-radiation characteristic is achieved directly downwards, that is, in the direct direction of radiation of the LED illuminants 110 by virtue of the fact that the light-radiating element 130 has a large scattering effect in this region. In the lateral direction, that is, in the vicinity of the edge of the luminaire 10, on the other hand, a directional light-radiation characteristic is to be achieved. For this, the light-radiating element 130 is formed in this region so that it is largely transparent and only scatters the traversing light a little. This is dealt with in greater detail with reference to FIGS. 2-5.

For further scattering of the light-radiation characteristic of the luminaire 10, the cover 33 is divided into a plurality of sections 31, 32. Located in the vicinity of the light-radiating element 130 is the first section 32 of the cover 33. This first section is provided with a first light-radiation characteristic. Located in the region close to the edge of the luminaire 10, that is, remote from the light-radiating element 130, is the second section 31 of the cover 33. Here, the cover 33 is provided with a second light-radiation characteristic. Thus further fine adjustment of the light quality can be effected in the various regions that are to be illuminated. For example, diffuse, very uniform illumination is possible in the region of the light-radiating element 130 directly in the direction of the light-exit opening of the luminaire 10, whilst in the lateral region, that is, to the side of the direct direction of radiation, illumination that is less diffuse are achieved with at the same time a higher degree of efficiency on account of lower losses as a result of scattering.

The reflector 30 is likewise connected to the carrier element 120. In the case of a conventional luminaire, one or more fluorescent tubes would be located at the focal point of the reflector 30. These would be arranged perpendicularly with respect to the sectional plane of the drawings. The light-radiating element 130 is formed here in such a way that its outer form largely corresponds to the contour of the fluorescent tube or fluorescent tubes in a conventional luminaire.

The reflector 30 projects into the region of the light-radiating element 130. In other words, the reflector 30 and the light-radiating element 130 overlap in part. The reflector 30 has a first light-radiation characteristic outside the light-radiating element 130. In the region inside the light-radiating element 130, the reflector has a second light-radiation characteristic. As a result, the whole light-radiation characteristic of the luminaire 10 can be adjusted further.

Advantageously, moreover, the surface of the carrier element 120 that is directed in the direction of the light-radiation is provided with a coating of high reflectivity. A further increase in the degree of efficiency of the luminaire can thus be attained.

Figure 2:
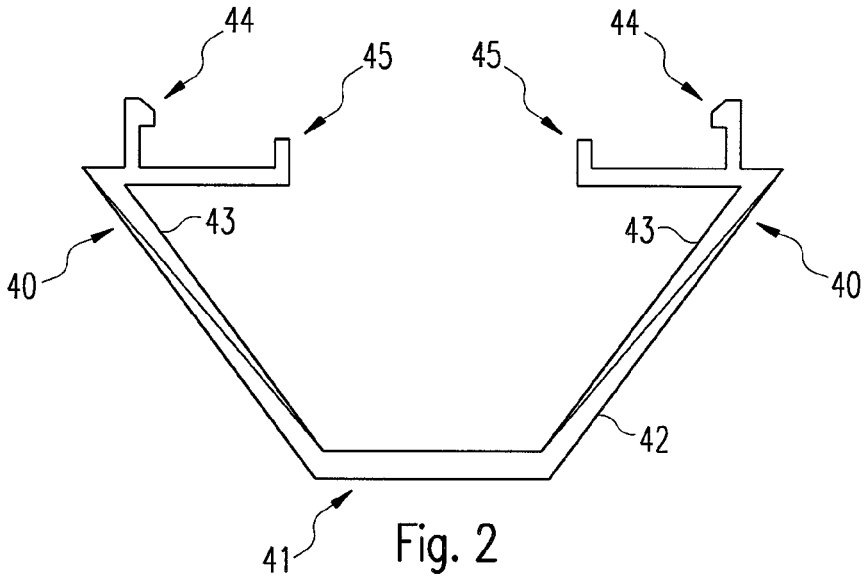
FIG. 2 shows a first exemplary embodiment of the arrangement in accordance with the invention in a detailed view.

FIG. 2 shows a first exemplary embodiment of the light-radiating element 130 from FIG. 1. Here as well, the light-radiating element is shown in a cross-sectional representation. The substantially trapezoidal cross section is clearly recognizable. The light-radiating element 130 is provided with holding strips 45 and securing strips 44 in the upper region in order to secure it to the carrier element 120 from FIG. 1.

The light-radiating element shown here consists of two different materials 42, 43. In a first region 41, which is located directly underneath the LED illuminant and thus in the main direction of radiation, the light-radiating element consists mainly of a first material 42. This first material 42 has a very strong scattering effect. In other words, traversing light undergoes strong scattering. In a second region 40 at the edge of the light-radiating element, that is, to the side with respect to the main direction of radiation of the LED illuminants, the light-radiating element predominantly consists of a second material 43. This second material 43 is largely transparent or has at least significantly fewer scattering properties than the first material 42.

In the exemplary embodiment shown here, there is a smooth transition between the first material 42 and the second material 43. This is achieved here by means of a reduction in the material cross section of the first material 42, starting from the first region 41 through to the second region 40, and a simultaneous increase in the material cross section of the second material 43. As a result of the decrease in the cross section of the strongly scattering first material 42, the scattering effect becomes less, the further away from the first region 41 a light beam penetrates the radiating element. Alternatively, however, there can also be an abrupt transition from the first material 42 to the second material 43.

Figure 3:
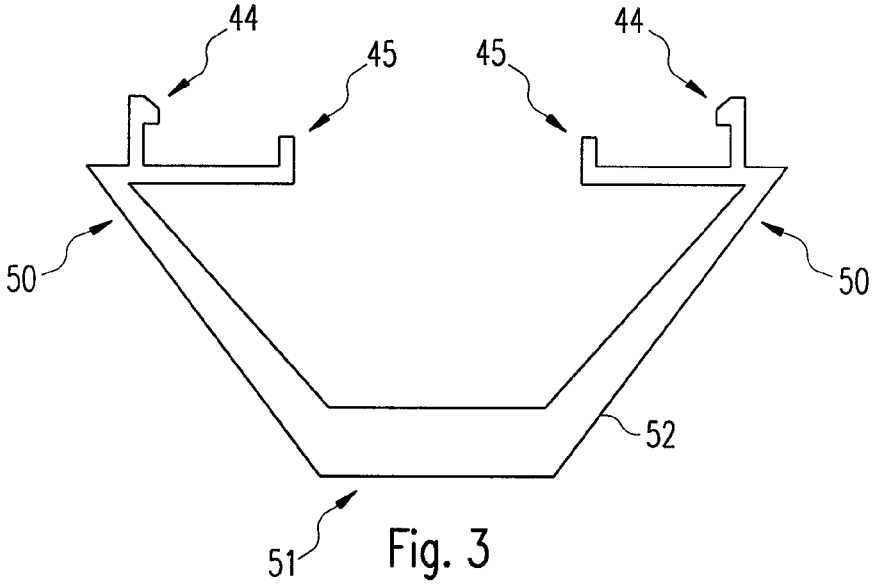
FIG. 3 shows a second exemplary embodiment of the arrangement in accordance with the invention in a detailed view.

A second exemplary embodiment of the light-radiating element 130 from FIG. 1 is shown in FIG. 3. The light-radiating element shown here consists merely of a single material 52. This material 52 has scattering properties. The greater the thickness of the material 52 is, the stronger the scattering properties are. In a first region 51, the light-radiating element has a very great thickness. In a second region 50, the light-radiating element has a very small thickness. Thus, just as in FIG. 2, a situation is reached where in the first region 51 a strong scattering effect occurs, whilst in the second region 50 merely a small scattering effect is attained.

In the two exemplary embodiments shown in FIG. 2 and FIG. 3, the light-radiating element has sharp edges. However, this is only an exemplary configuration. Rounded edges are likewise conceivable and additionally ensure that the illumination is more uniform.

Figure 4:
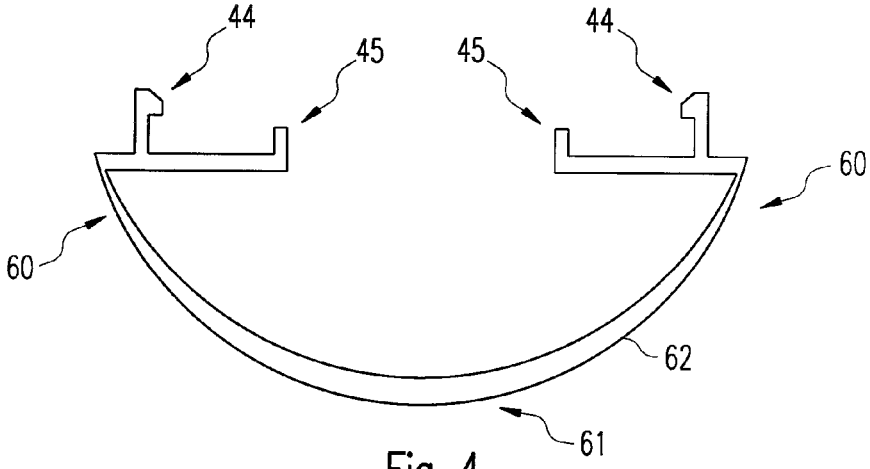
FIG. 4 shows a third exemplary embodiment of the arrangement in accordance with the invention in a detailed view.

FIG. 4 shows a third exemplary embodiment of the arrangement in accordance with the invention for light-emission in a detailed view. Here as well, merely the light-radiating element 130 from FIG. 1 is shown. This light-radiating element is also provided with a first region 61 and a second region 60. Just like the light-radiating element shown in FIG. 3, it consists merely of a single material 62 which has a scattering effect that is dependent upon its material thickness. The light-radiating element shown here differs from the light-radiating element shown in FIG. 3 merely as a result of its form in the cross-sectional representation. Thus, the light-radiating element shown here has a rounded form, in particular a circular-arc-shaped form, in the cross-sectional representation. Illumination that is even more uniform can be achieved by means of this shaping.

Figure 5:
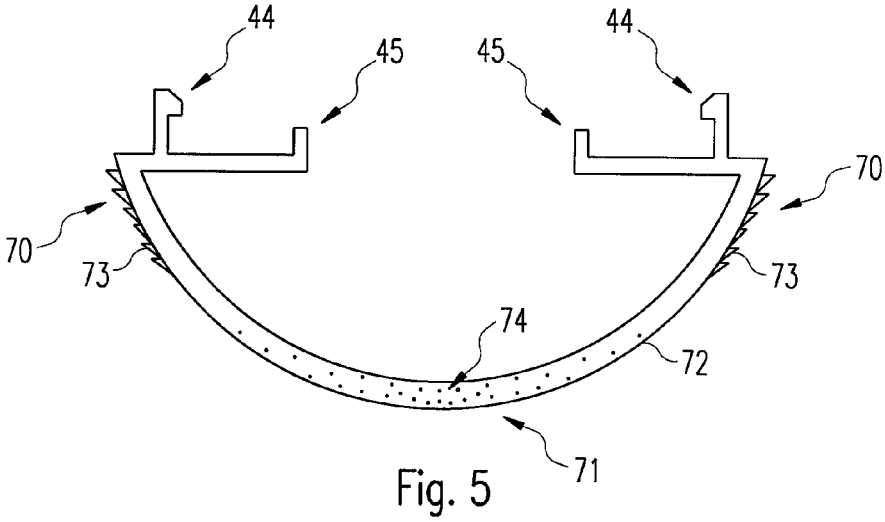
FIG. 5 shows a fourth exemplary embodiment of the arrangement in accordance with the invention in a detailed view.

A fourth exemplary embodiment of the arrangement in accordance with the invention for light-emission is shown in a detailed view in FIG. 5. Here as well merely the light-radiating element 130 from FIG. 1 is shown. Just as in FIG. 4, the light-radiating element shown here has a rounded form in the cross-sectional representation.

This light-radiating element also consists merely of a single material 72. It has largely a uniform wall thickness.

This light-radiating element is also provided with a first region 71 and a second region 70. In the first region 71, a high number of scattering particles 74 is incorporated in the material 72. Thus a high scattering effect on traversing light is achieved in the first region 71. At the same time, in the second region 70 a very small scattering effect on traversing light is achieved, since there merely a very small number of scattering particles 74 is introduced into the material 72.

In the exemplary embodiment shown here, furthermore, prism-shaped elevations 73 are applied on the outside of the light-radiating element in the second region 70. As a result of their precise shaping, further guidance of the traversing light is effected in desired directions. Instead of prism-shaped elevations 73, prism-shaped depressions can also be used. A combination of elevations 73 and depressions is also possible. The prism-shaped elevations 73 and/or depressions give rise to further improvement in the controllability of the light-radiation characteristic.

The invention is not limited to the exemplary embodiment shown. Profiles of the light-radiating element that deviate therefrom are also conceivable. Use without a reflector is within the inventive idea too. A combination of the materials and light-radiation characteristics put forward here is also possible. All of the features described above or features shown in the figures can be combined with each other advantageously in any way within the scope of the invention.

The invention claimed is:

1. An arrangement for light-emission (100), having a plurality of LED illuminants (110) in an elongate arrangement, a carrier element (120), which carries the plurality of LED illuminants, and a light-radiating element (130), which can be connected to the carrier element, characterised in that the light-radiating element (130) has a first region (41, 51, 61, 71) in which traversing light is scattered to a large extent, and in that the light-radiating element (130) has a second region (40, 50, 60, 70) in which traversing light is scattered to a significantly smaller extent than in the first region (41, 51, 61, 71), further characterised in that the light-radiating element (130) is formed as a profiled body with a substantially trapezoidal cross section or with a substantially rounded cross section in a cross-sectional plane, and in that a normal of the cross-sectional plane corresponds to the longitudinal direction of the plurality of LED illuminants (110).

2. An arrangement for light-emission according to claim 1, characterised in that the light-radiating element (130) consists of a diffuse first material (52, 62), in that the scattering properties of the first material (52, 62) increase with increasing thickness of the material, and in that the light-radiating element (130) has a greater material thickness in the first region (51, 61) than in the second region (50, 60).

3. An arrangement for light-emission according to claim 1, characterised in that the light-radiating element (130) in the first region (41) consists to a large extent of a diffuse second material (42), and in that the light-radiating element (130) in the second region (40) consists to a large extent of a largely clear third material (43).

4. An arrangement for light-emission according to claim 1, characterised in that the light-radiating element (130) in the second region (70) is provided with prism-shaped elevations (73) and/or depressions on its side remote from the light-radiating direction, and in that the prism-shaped elevations (73) and/or depressions guide the radiated light.

5. An arrangement for light-emission according to claim 1, characterised in that the carrier element (120) and the light-radiating element (130) are connected in a reversibly releasable manner, and in that the carrier element (120) and the light-radiating element (130) are connectable and releasable without a tool.

6. An arrangement for light-emission according to claim 1, characterised in that the carrier element (120) is reversibly connectable to an illuminant-carrier, in that the illuminant-carrier is an LED printed circuit board, and in that the carrier element (120) and the illuminant-carrier are connectable and releasable without a tool.

7. An arrangement for light-emission according to claim 1, characterised in that limiting faces of the light-radiating element (130) in sections corresponds substantially with a surface form of one or more fluorescent tubes that can be arranged between the carrier element (120) and the light-radiating element (130).

8. A luminaire (10) having a housing (20), a light-exit opening (30), fixed by the housing (20), and also an arrangement for light-emission according to claim 1.

9. A luminaire according to claim 8, characterised in that the carrier element (120) is connected directly to the housing (20) and/or completes a wall of the housing (20).

10. A luminaire according to claim 8, characterised in that the carrier element (120) is connected to the housing (20) in a reversibly releasable manner, and in that the carrier element (120) and the housing (20) are connectable and releasable without a tool.

11. A luminaire according to claim 8, characterised in that the luminaire (10) has a reflector (40) which has at least one focal point in a cross-sectional representation, and in that sections of the limiting face of the light-radiating element (130) correspond with the focal point.

12. A luminaire according to claim 11, characterised in that the carrier element (120) is reflective in the region of the light-radiating element (130), in that the reflector (30) borders directly on the carrier element (120), in that the reflector (30) is connected to the carrier element (120), and in that the reflector (30) and the carrier element (120) are reversibly connectable and releasable without a tool.

13. A luminaire according to claim 11, characterised in that at least a first portion of the reflector (30) is arranged between the carrier element (120) and the light-radiating element (130), in that at least a second portion of the reflector (30) is not arranged between the carrier element (120) and the light-radiating element (130), in that the first portion of the reflector (30) and the second portion of the reflector (30) have different radiation characteristics.

14. An arrangement for light-emission comprising, at least one LED illuminant (110) in an elongate arrangement, a carrier element (120), which carries the at least one LED illuminant, and a light-radiating element (130), which can be connected to the carrier element, wherein the light-radiating element (130) has a first region (41, 51, 61, 71) in which traversing light is scattered to a large extent, and in that the light-radiating element (130) has a second region (40, 50, 60, 70) in which traversing light is scattered to a significantly smaller extent than in the first region (41, 51, 61, 71)

characterised in that the light-radiating element (130) consists of a fourth material (72), in that scattering particles (74) can be incorporated in the fourth material, in that a high number of scattering particles are incorporated in the fourth material (72) in the first region (71), and in that a small number of scattering particles are incorporated in the fourth material (72) in the second region (70).

15. A luminaire (10) having a housing (20), a light-exit opening (30), fixed by the housing (20), an arrangement for light-emission (100) comprising, at least one LED illuminant (110) in an elongate arrangement, a carrier element (120), which carries the at least one LED illuminant, and a light-radiating element (130), which can be connected to the carrier element, wherein the light-radiating element (130) has a first region (41, 51, 61, 71) in which traversing light is scattered to a large extent, and in that the light-radiating element (130) has a second region (40, 50, 60, 70) in which traversing light is scattered to a significantly smaller extent than in the first region (41, 51, 61, 71), characterised in that the luminaire (10) has a cover (33) of the light-exit opening arranged downstream of the light-radiating element (130) in the optical path, in that the cover (33) has a central region (32) close to the light-radiating element (130), in that the cover (33) has a lateral region (31) further away from the light-radiating element (130), and in that the cover (33) has different light-radiation characteristics in the lateral region (31) and in the central region (32).

16. A luminaire according to claim 15, characterised in that the cover (33) has a diffuse light-radiation characteristic in the central region (32), and in that the cover (33) has a directed light-radiation characteristic in the lateral region (31).

* * * * *